US007762014B2

(12) United States Patent
Brock et al.

(10) Patent No.: US 7,762,014 B2
(45) Date of Patent: Jul. 27, 2010

(54) BUCKET DEBRIS GUARD

(75) Inventors: Knute Brock, Bismarck, ND (US); Nathan Hulstein, Litchfield, MN (US)

(73) Assignee: Clark Equipment Company, West Fargo, ND (US)

( * ) Notice: Subject to any disclaimer, the term of this patent is extended or adjusted under 35 U.S.C. 154(b) by 0 days.

(21) Appl. No.: 12/111,308

(22) Filed: Apr. 29, 2008

(65) Prior Publication Data

US 2009/0265963 A1 Oct. 29, 2009

(51) Int. Cl.
*E02F 3/40* (2006.01)

(52) U.S. Cl. ..... 37/444; 37/403; 37/903; 414/722

(58) Field of Classification Search ..... 37/443, 37/444, 903, 403; 414/722
See application file for complete search history.

(56) References Cited

U.S. PATENT DOCUMENTS

| | | | | | |
|---|---|---|---|---|---|
| 2,722,758 | A | * | 11/1955 | Loftin et al. | 37/301 |
| 3,033,395 | A | | 5/1962 | Lowery | 214/140 |
| 3,121,964 | A | | 2/1964 | Cobb | 37/143 |
| 3,195,250 | A | * | 7/1965 | Robinson | 172/776 |
| 3,718,222 | A | | 2/1973 | Foster | 214/145 |
| 3,807,587 | A | | 4/1974 | Maurer | 214/145 |
| 3,845,870 | A | | 11/1974 | Balderson et al. | 214/145 |
| 4,125,952 | A | * | 11/1978 | Jennings | 37/405 |
| 4,178,034 | A | * | 12/1979 | Mittendorf | 296/91 |
| 4,200,423 | A | * | 4/1980 | Sornsin | 414/724 |
| 4,309,142 | A | | 1/1982 | Shumaker | 414/722 |
| 4,349,308 | A | | 9/1982 | Buckstead et al. | 414/725 |
| 4,395,193 | A | | 7/1983 | Christensen et al. | 414/722 |
| 4,407,080 | A | | 10/1983 | Mann | |
| 4,477,987 | A | | 10/1984 | Stecklein | 37/118 |
| 4,523,397 | A | | 6/1985 | Lucas | 37/118 |
| 4,779,363 | A | | 10/1988 | Boutrais et al. | 37/117.5 |
| 4,819,349 | A | * | 4/1989 | Mensch | 37/407 |
| 4,991,662 | A | * | 2/1991 | Caron et al. | 172/701.1 |
| 5,079,864 | A | * | 1/1992 | Roy | 37/302 |
| 5,097,609 | A | * | 3/1992 | Swaggert | 37/403 |
| 5,253,449 | A | * | 10/1993 | Webb et al. | 37/446 |
| 5,392,864 | A | * | 2/1995 | Lindenmuth | 172/811 |
| 5,599,158 | A | * | 2/1997 | Ajilore | 414/685 |
| 5,702,227 | A | | 12/1997 | Berg | 414/704 |

(Continued)

FOREIGN PATENT DOCUMENTS

| | | |
|---|---|---|
| JP | 2001 040688 | 2/2001 |

(Continued)

OTHER PUBLICATIONS

International Search Report and Written Opinion.

*Primary Examiner*—Thomas A Beach
(74) *Attorney, Agent, or Firm*—Westman, Champlin & Kelly, P.A.

(57) ABSTRACT

A removable and attachable debris guard for a back wall of a loader bucket or a bulldozer blade is provided with a frame that is a generally inverted U-shape with outwardly tapering side legs, and has a strong mesh screen supported on the frame. The frame includes a cross plate that extends rearwardly of the mesh screen and has attachment hooks for fitting over a top rail of a back wall of a loader bucket. The frame includes brackets for securing the legs to a forward side of the back wall.

10 Claims, 4 Drawing Sheets

U.S. PATENT DOCUMENTS

| | | | | |
|---|---|---|---|---|
| 5,732,488 | A * | 3/1998 | Smith | 37/468 |
| 5,915,914 | A | 6/1999 | Hadiken | 414/722 |
| 5,950,699 | A * | 9/1999 | Dove | 144/34.6 |
| 5,967,242 | A * | 10/1999 | Caron et al. | 172/817 |
| 6,439,279 | B1 * | 8/2002 | Underwood | 144/34.6 |
| 6,574,890 | B2 * | 6/2003 | Bateman, Jr. | 37/264 |
| 6,763,618 | B1 * | 7/2004 | Moran | 37/301 |
| 6,901,978 | B2 * | 6/2005 | Simpson | 144/339 |
| 7,066,275 | B1 * | 6/2006 | Keigley | 171/63 |
| 2007/0212207 | A1 * | 9/2007 | Gust | 414/722 |
| 2007/0283674 | A1 * | 12/2007 | Watkins | 56/257 |

FOREIGN PATENT DOCUMENTS

| | | | |
|---|---|---|---|
| JP | 2001040688 | A * | 2/2001 |
| WO | WO 97/15734 | | 5/1997 |

* cited by examiner

BUCKET DEBRIS GUARD

BACKGROUND OF THE DISCLOSURE

The present invention relates to a debris guard that extends the height of the back wall of a bucket for a loader and which can be quickly installed to prevent rocks or other materials that might damage hydraulic components, lines and the like, from falling rearwardly. The debris guard is positioned in the center portions of the rear wall of the bucket during lifting, and can be easily removed when not needed.

Loader buckets and bulldozer blades with fixed upright extensions on the back wall have been used. These generally are inconvenient in most applications. In addition, many of the extensions that are presently known restrict visibility forwardly to see what is being scooped into the bucket or pushed with a bulldozer blade, so that the operator's view is restricted.

SUMMARY OF THE DISCLOSURE

The present disclosure provides a debris guard that can be quickly and easily attached to an upright wall of a bucket or to a dozer blade, and project upwardly from the normal height of the wall of the bucket, or from the blade. The debris guard of the present disclosure has a frame around a large size screen that will not substantially obstruct forward vision, but yet will have sufficient strength to resist impact from rocks that are in the bucket. The debris guard is effective when a bucket is tilted backwardly toward the operator and raised for dumping.

The debris guard is inclined forwardly from the upright wall of a bucket to which it is attached, so the bucket capacity remains about the same as when the debris guard is not used. Thus even though the debris guard extends above the top of the back wall, the bucket can not be overloaded. Additionally the attachment brackets for the debris guard do not obstruct the operators steps that are on the bucket back wall for use in stepping to the front entry operator's seat or cab.

The backstop or guard of the present disclosure catches rocks or large pieces of debris that may otherwise fall over the rear wall of the bucket onto hydraulic components, lines and controls that are used for controlling the bucket and also stops large rocks and debris from falling onto an operator or onto and operator's cab of the loader. Any debris that does fall though, has to pass through the openings of the debris guard.

DETAILED DESCRIPTION OF EXEMPLARY EMBODIMENTS

Figure 1:
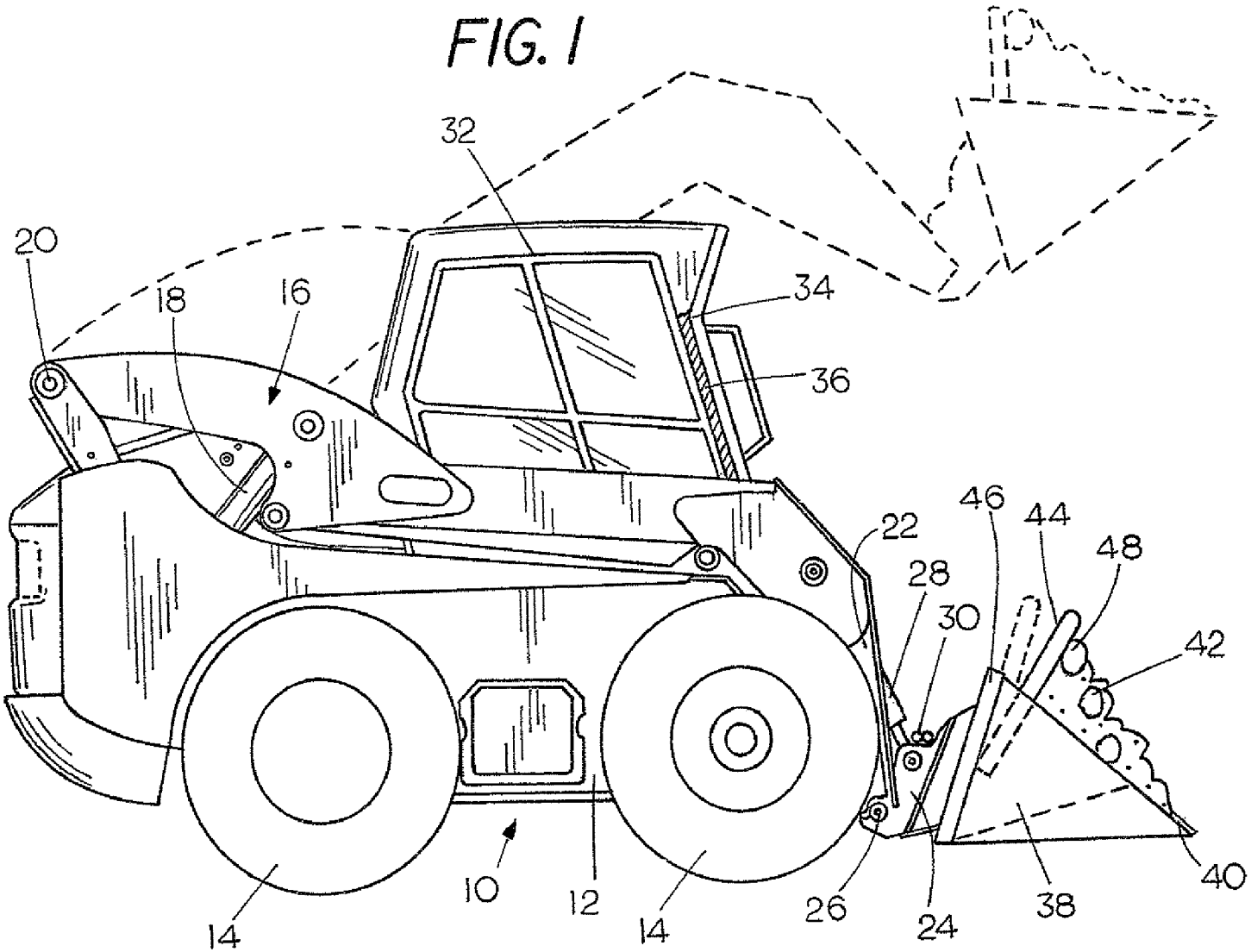
FIG. 1 is a schematic view of a typical loader having a bucket attached thereto with a debris guard of the present disclosure installed.
Figure 2:
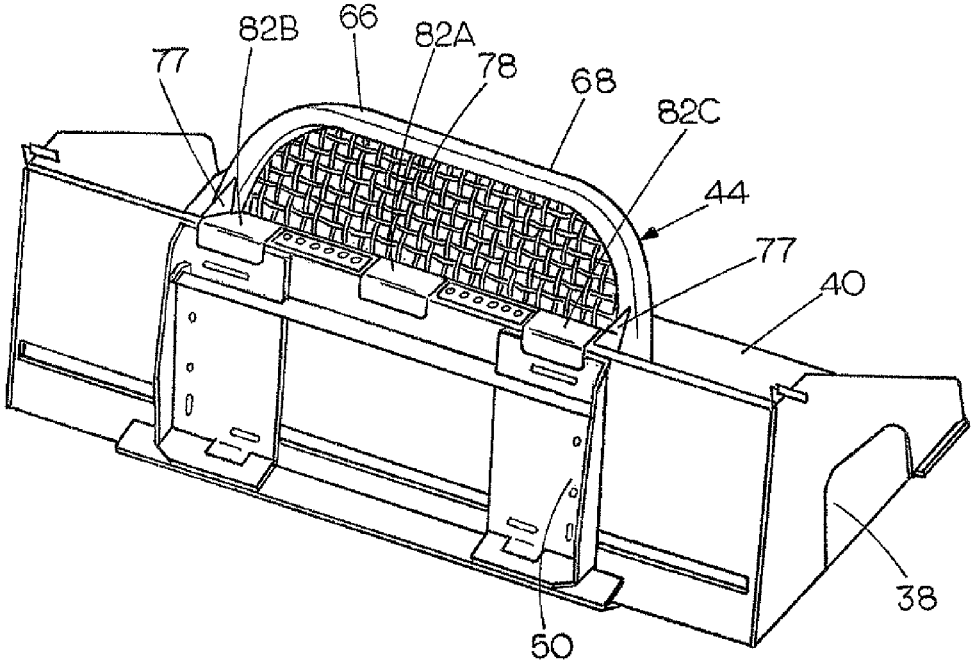
FIG. 2 is a rear perspective view of a bucket removed from the loader with the debris guard of the present disclosure installed.
Figure 3:
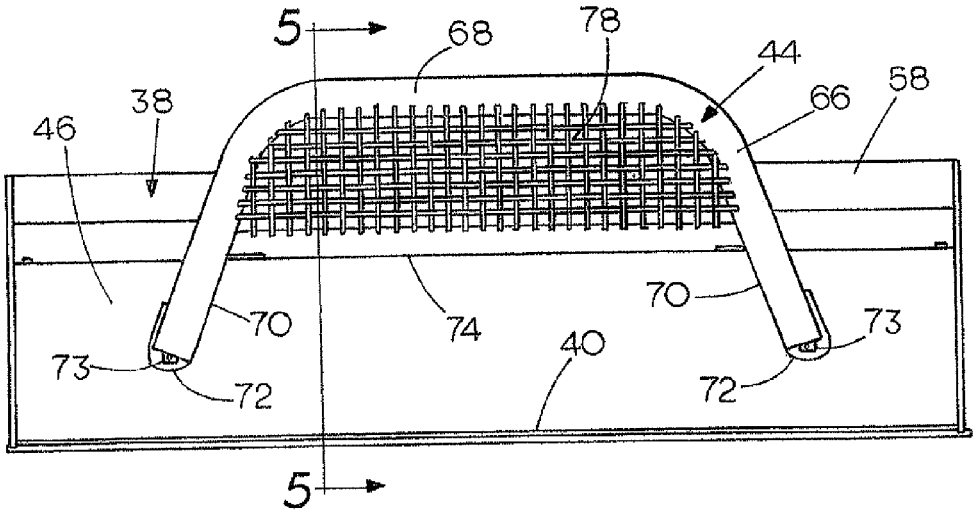
FIG. 3 is front view of the bucket and debris guard of FIG. 2.
Figure 4:
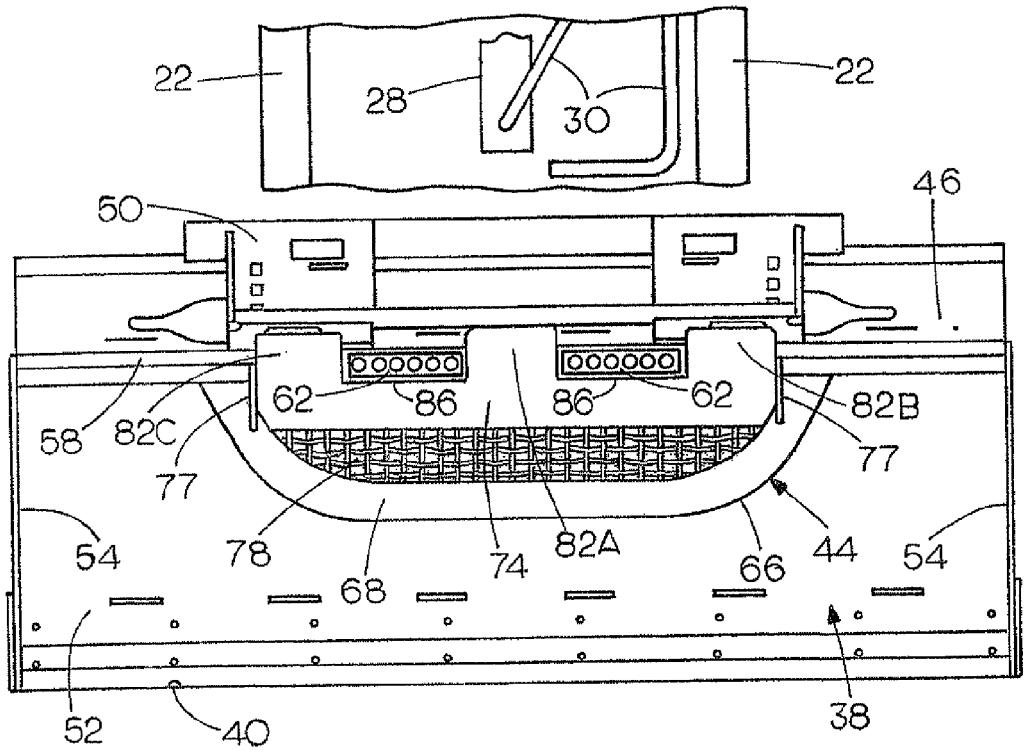
FIG. 4 is a top view of the bucket of FIG. 3.

Referring to FIG. 1, compact tool carrier comprising a compact loader 10 is illustrated. This is an exemplary showing of a typical loader with which the present debris guard finds usefulness. The tool carrier or loader 10 has a transmission case or frame 12 having drive components for wheels 14 for movement across the ground. The loader includes a lift arm assembly 16, which has lift arms on opposite sides of the loader frame, and the lift arms are raisable and lowerable using a hydraulic actuator 18 for pivoting the lift arm assembly about pivots 20, between raised and lowered positions in a normal manner. As shown, the forward ends of the lift arms indicated at 22 have a tilting attachment plate 24 pivotally mounted at 26 to the forward ends of the lift arms. Tilting of the attachment plate 24 is controlled by a tilt cylinder 28 operated through suitable valves. The tilt cylinder 28 is a hydraulic cylinder, and in many instances hydraulic components including hydraulic tubing, and fittings will be adjacent to the cylinder 28, and immediately behind the attachment plate 24. Rocks can also fall into openings between the pivoting parts and interfere with movement of the parts. Hydraulic tubing 30 is illustrated in FIGS. 1 and 4, for illustrative purposes only.

The loader 10 has an operator's cab 32 installed thereon, and the cab has a forward entry door 34 that is shown in cross section, with a glass pane 36 on the forward side. The cab surrounds the operator's seat or platform, which is entered from the front The tilting plate 24 carries a loader bucket 38, held onto the tilting plate 24 in a normal manner, such as that used on skid steer loaders sold under the trademark BOBCAT. The bucket 38 has a forward edge blade 40, for digging and loading the bucket with dirt and the like, and a typical load is indicated by line 42. The bucket 38 is an earth working implement, as is a bulldozer blade.

The bucket 38 is equipped with a debris guard 44 made according to the present disclosure. The debris guard 44 extends upwardly from the back wall 46 of the bucket, and as can be seen the load 42 can be built up higher than the back wall. The load can include large rocks 48.

When the bucket 38 is tilted rearwardly by the cylinder 28, with the loader arms lowered as shown in dotted lines in FIG. 1, the back wall 46 of the bucket will be substantially perpendicular to the ground, and this will tilt the bottom wall of the bucket upwardly as indicated in dotted lines in FIG. 1. When the bucket 38 without a debris guard is tilted rearwardly, rocks such as that shown at 48 can spill over the back wall, and then hit the tubing illustrated at 30 or other hydraulic or control components immediately behind the tilting plate 34. When the lift arm assembly 16 is raised, the bucket 38 will tend to tilt rearwardly more so that any rocks or debris could fall and even strike an operator in the operator's seat, if there is no cab, and debris can damage the operator's front window 36, as well as falling onto the tilt cylinder 28 and conduits leading to controls for that cylinder.

When the debris guard 44 is installed, the back wall 46 retaining the load 42 is extended to a height that will retain the load, including rocks 48, in the bucket without spilling over the back wall.

The debris guard 44 is shown in FIGS. 3-7 in more detail. The bucket 38, has an attachment plate 50 that latches onto the tilting plate 24 of the loader to mount the bucket on the loader arms, which are broken away in FIG. 4.

The bucket 38 includes a bottom wall 52, side walls 54, and the back or rear wall 46. The back wall 46 has a formed top rail 58 (FIG. 6), that is secured to a formed top wall section 60 of the rear wall 46. The top rail 58 also supports operator access steps 62, that are for the operator to use for entering the operator's platform, which is entered from the front, through front door 34 of the cab 32 of the loader, when a cab is provided. These steps 62 are provided on standard loader buckets for compact tool carriers such as compact loaders.

The debris guard 44 is constructed so that it can be easily installed and removed from the bucket back wall 46. This can be done in the field, so if the conditions are such that a debris guard is desired, it can be quickly and easily attached. The debris guard includes a formed tubular outer frame 66, that is made of heavy pipe formed into a gentle U-shape where a straight top section 68, and side legs 70 that have attachment brackets 72 at lower ends thereof. The brackets 72 are bent so a lower portion fits against the back wall with the debris guard inclined forwardly, and are provided with openings through which fasteners, such as bolts 73 can be placed. The bracket 72 can be securely bolted to the back wall 46 of the bucket.

Figure 5:
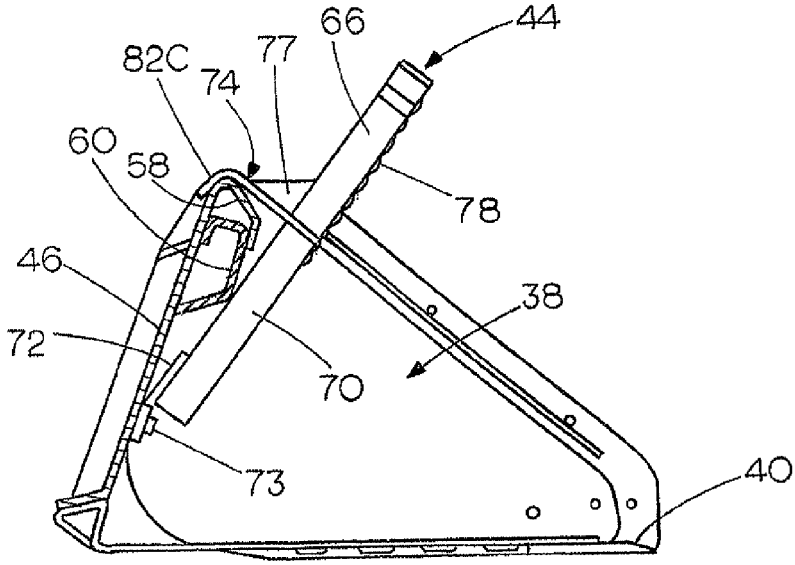
FIG. 5 is a sectional view taken as on line 5-5 in FIG. 3.

The frame 66 has a cross plate 74 extending between the legs 70 and the plate has a flange 75 at the front edge. The plate 74 is welded in place to the legs 70, and braced with gussets 77. The cross plate 74 is positioned so that it lies along a plane generally from the upper edge of the formed rail 58 to the forward edge of the cutting blade 40, as shown in FIG. 5, and forms a space or opening between the arms 70, and below the cross member 68 but above the cross plate 74. This opening is covered with a sturdy open mesh screen 78, that is welded to the debris guard frame 66, and the flange 75 of the cross plate 74. The mesh screen 78 is made of relatively heavy metal wire or rod material, with fairly large openings. For example, a screen made with openings that are in the range of 1 inch to 1.5 inches inside dimension, is suitable, with rods 3/16 to 5/16 inches in diameter, with the preferred opening size being 1.25 inches square with ¼ inch diameter rods. Smaller wire or rods can be used with smaller openings, but visibility should not be overly restricted, and openings that are extra large let debris and rocks fall through.

The rods or wire for the screen 78 are sturdy, but has large openings that do not substantially affect the visibility through the screen so that an operator of a compact loader can see the bucket blade 40 during operation are desired.

Figure 6:
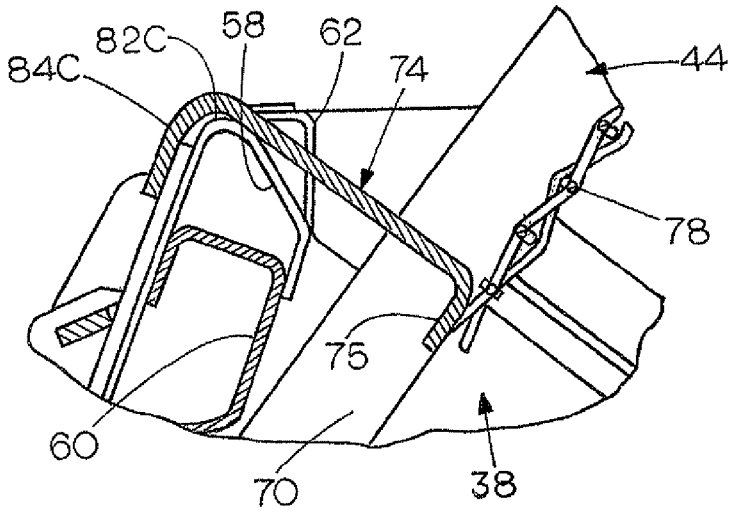
FIG. 6 is an enlarged view taken substantially on the same line as FIG. 5 to show the detail of a mounting attachment hook on the top rail of the bucket.
Figure 7:
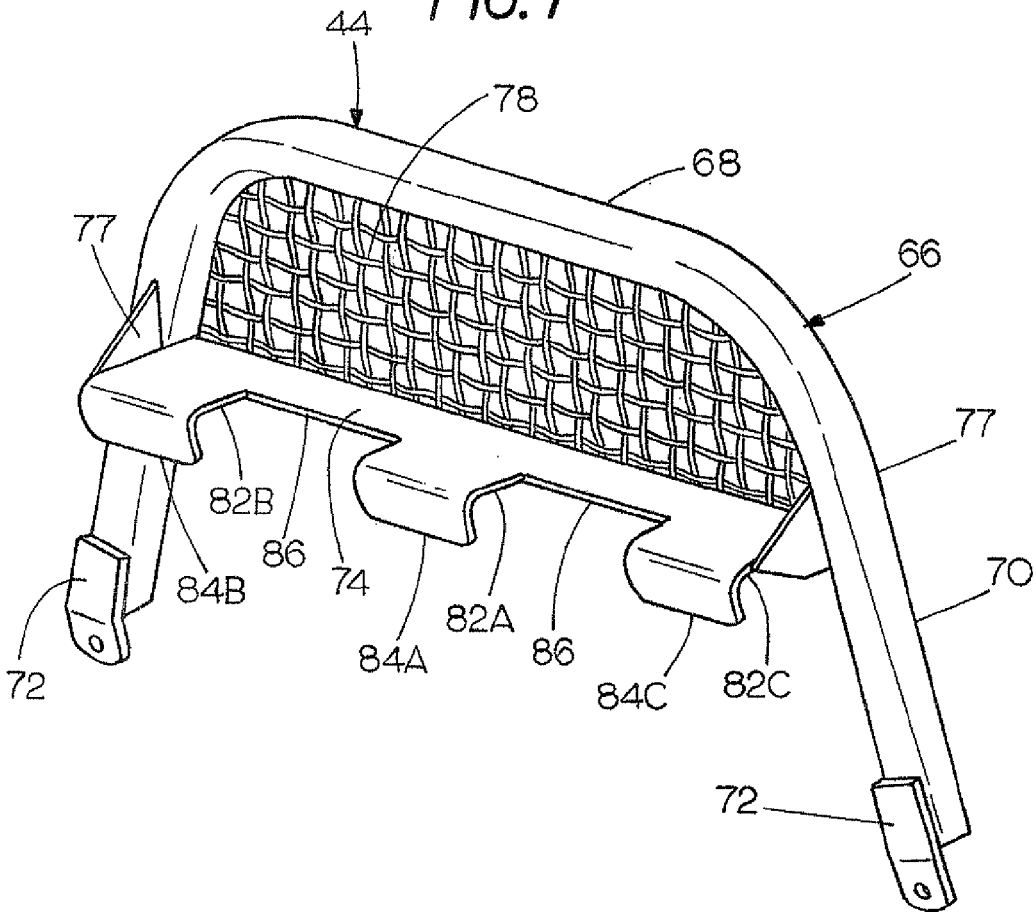
FIG. 7 is a rear perspective view of the present debris guard when removed from a bucket.

The cross plate 74 extends rearwardly from the plane of frame 66, as shown in FIGS. 5-7, for example. This plate 74 has cut out sections to form three hooks 82A, 82B and 82C. These hooks include a center hook 82A between the operator's steps 62. Hooks 82A and 82B fit on the outside of the operator steps. The cross plate also spaces the screen away from the back wall so the plane of the screen 78 inclines forwardly in the range of 15 to 20 degrees but other inclinations are usable. When material is piled against the forwardly inclined screen, the bucket capacity is about the same as without the debris guard, so the bucket will not be over loaded.

The hooks 82A, 82B. and 82C have flanges 84A, 84B and 84C that hook over the top rail 58 of the back wall 46. Hooks 84A, 84B and 84C prevent forward tilting of the debris guard relative to the back wall 46, and the edges 86 of the cutout sections that form the hooks 82A, 82B, and 82C form stops against the steps 62 to prevent rearward movement of the frame 66 of the debris guard 44. Once the brackets 72 are both secured in place with bolts 73, after the hooks have been placed over the top rail 58, the debris guard is securely held in position and as stated it is angled forwardly. The debris guard is quickly and easily installed. When it is installed, the operator steps 62 are exposed and can be used to enter the operators seat area or, as shown, cab 32 in a normal manner. The steps are easily accessed from the side, and the forward tilting of the debris guard helps the accessibility of the steps.

Again, the open mesh screen 78, which is sturdy enough to withstand blows from rocks rolling backwardly on the load 44, does not obstruct the observation of the bucket by the operator to any substantial degree.

If the compact loader and bucket are used for loading materials that contain no large rocks or chunks, the debris guard 44 can be removed merely by removing the bolts shown at 73 that hold the brackets 72 in place and then the hooks 82A, 82B and 82C can be lifted off the top rail 58.

The debris guard 44 is thus an easily installed accessory that reduces the chances of rocks or other debris from tumbling over the back wall of a loader bucket or over the wall of a bulldozer blade. In the case of use on a loader without a debris guard, when filling the bucket above the operator's eye level and moving into a bank, the material in the bucket can overflow the bucket back wall and spill back onto the operator. Also spilling back of debris when the bucket is raised for dumping can occur without the present debris guard. With the debris guard installed the spillage over the back is limited and if any material does spill it must pass through the openings in the debris guard screen, so the pieces are small.

The debris guard is easily manufactured, and easily installed and removed in the field, as desired. The installation features using the hooks and a few fasteners makes field installation when needed and removed when not needed fast and convenient.

The width of the debris guard, as shown, is generally within the center portions of the width of the back wall of the loader bucket, so that the bucket edges, where loads generally do not pile up as high as in the center are not obstructed.

The side legs 70 of frame 66 also taper outwardly from the straight top section 68, to keep the top section of the framework narrower, while providing great stability by having the brackets 72 adequately spaced apart.

Although the present invention has been described with reference to preferred embodiments, workers skilled in the art will recognize that changes may be made in form and detail without departing from the spirit and scope of the invention.

What is claimed is:

1. A removable attachment for mounting to a loader bucket having a bottom wall, side walls and an upright rear wall, the bucket being moved under power to engage and receive materials, the attachment comprising a removable debris guard, including a debris guard frame having spaced apart side legs having lower ends, and a top member joining the side legs, a cross member between the side legs spaced downwardly from the top member and above the lower ends, a mesh screen covering a space formed between the top member and the cross member and secured to the debris guard frame and the cross member, the cross member having a hook adapted to go over a top edge of an upright rear wall of the loader bucket to prevent forward movement of the debris guard frame relative to the upright rear wall, and having a portion which engages parts of the upright rear wall to prevent rearward movement relative to the upright rear wall, to retain the debris guard inclined forwardly from and extending upwardly from the upright rear wall, the side legs extending beyond the cross member in a direction away from the top member and the lower ends of the side legs having attachment brackets for removably attaching to a forward side of the upright rear wall.

2. The attachment of claim 1 wherein the mesh screen has openings of at least 1 inch in major dimension, and is made of rods formed with mutually perpendicular lengths.

3. The attachment of claim 1 wherein said cross member is provided with side gussets for securing the cross member to the debris guard frame.

4. A debris guard for removable attachment to an upright wall of an earth working implement, the upright wall being supported on a prime mover, said debris guard comprising a frame having a top cross member, and side legs, lower ends of the side legs having attachment brackets for removably attaching to the upright wall on a forward side thereof, a mesh screen supported on the frame and extending between the side legs and below the top cross member, and a cross plate secured to and extending between the side legs, and supporting a lower side of the mesh screen, the cross plate having at least one hook for fitting over an upper edge of the upright wall when the frame is mounted on a forward side of the upright wall and the cross plate having portions which engage a forward side portion of the upright wall, whereby the at least one hook prevents forward movement of the debris guard frame and the cross plate portions prevent rearward movement of the debris guard frame when placed on an upright wall of the earth working implement.

5. The debris guard of claim 4, wherein the at least one hook is positioned so that when the debris guard is in place on the upright wall, the at least one hook is to a lateral side of a step supported on such upright wall.

6. The debris guard of claim 4, wherein the upright wall is a rear wall of a loader bucket and wherein there are two spaced apart step members on an upper rail of the rear wall of a bucket on which the debris guard is installed, and wherein the cross plate has three hooks, a first center hook adapted to be positioned between the step members, and a pair of end hooks adapted to be positioned on sides of the two step members when the debris guard is in position on the rear wall, the portions of the cross plate comprising edge portions between the hooks positioned to engage the step members to prevent rearward movement of the debris guard frame.

7. A debris guard for a loader bucket back wall comprising a debris guard frame having spaced apart side legs, and a top member joining the side legs, a cross member between the legs spaced downwardly from the top member, the cross member extending outwardly from the debris guard frame and having at least one flange to form a hook for hooking over a top edge of the bucket back wall and having a portion that engages a portion of the bucket back wall to prevent movement of the debris guard frame relative to the bucket back wall, the cross member spacing the debris guard frame forwardly from the top edge with the side legs on a forward side of the bucket back wall, a mesh screen secured to the debris guard frame and covering a space formed between the top member and the cross member, the side legs extending beyond the cross member in a direction away from the top member and having attachment brackets at ends thereof for engaging a forward side of the bucket back wall below the cross member, and wherein the top member of the debris guard frame is positioned forwardly of the bucket back wall of a bucket on which the debris guard is mounted, with the attachment brackets engaging a forward side of such bucket back wall.

8. The debris guard of claim 7, wherein the mesh screen has square openings ranging between 1 inch and 1.5 inches in dimension and is made of mutually perpendicular rods ranging between 3/16 and 5/16 inches in diameter.

9. The debris guard of claim 7, wherein the bucket back wall of a bucket on which the debris guard is installed has a step on a top edge thereof, the hook being located to be laterally of the step to permit access to use the step.

10. The debris guard of claim 7, further characterized by the attachment brackets defining a plane, and the side legs being angled such that the top member is spaced from the plane so the mesh screen angles away from the plane.

* * * * *